US009239134B1

(12) United States Patent
Macias

(10) Patent No.: US 9,239,134 B1
(45) Date of Patent: Jan. 19, 2016

(54) FLEXIBLE AND ADAPTABLE LIGHT HARNESS AND WIRING

(71) Applicant: Guillermo Macias, Santa Clarita, CA (US)

(72) Inventor: Guillermo Macias, Santa Clarita, CA (US)

(73) Assignee: COLT INTERNATIONAL CLOTHING INC., Santa Clarita, CA (US)

( * ) Notice: Subject to any disclaimer, the term of this patent is extended or adjusted under 35 U.S.C. 154(b) by 0 days.

(21) Appl. No.: 14/613,258

(22) Filed: Feb. 3, 2015

Related U.S. Application Data

(60) Provisional application No. 61/935,690, filed on Feb. 4, 2014.

(51) Int. Cl.

| | |
|---|---|
| ***F21S 4/00*** | (2006.01) |
| ***F21K 99/00*** | (2010.01) |
| ***F21V 23/00*** | (2015.01) |
| *F21Y 103/00* | (2006.01) |

(52) U.S. Cl.
CPC . *F21K 9/17* (2013.01); *F21S 4/008* (2013.01); *F21V 23/001* (2013.01); *F21Y 2103/003* (2013.01)

(58) Field of Classification Search
None
See application file for complete search history.

(56) References Cited

U.S. PATENT DOCUMENTS

| | | | | |
|---|---|---|---|---|
| 4,852,832 | A * | 8/1989 | Delaney | F16L 3/08 211/26 |
| 5,452,187 | A * | 9/1995 | Belfer | F21S 4/003 362/221 |
| 6,244,733 | B1 * | 6/2001 | Fong | F21V 21/35 362/147 |
| 7,293,865 | B2 * | 11/2007 | Tsukuda | B41J 2/17526 347/50 |
| 2004/0160767 | A1 * | 8/2004 | Mobarak | H01R 25/142 362/219 |
| 2005/0117339 | A1 * | 6/2005 | Pan | A47F 11/00 362/249.01 |

OTHER PUBLICATIONS lightingballoons.com/products/46/LED-blanket-large: LED Blanket: 2'×2' (15×.5m); SourceMaker Lighting Balloons; one page; Nov. 6, 2014.

* cited by examiner

*Primary Examiner* — Ashok Patel
(74) *Attorney, Agent, or Firm* — David L. Hoffman; Hoffman Patent Group

(57) ABSTRACT

A light harness for holding a plurality of elongate lights includes a first flexible elongate member, a second flexible elongate member, a primary power cable attached to the first flexible elongate member, a first receiving section that is attached to the first flexible elongate member and is formed with a first opening for elastically receiving a first end of an elongate light, a second receiving section that is attached to the second flexible elongate member and is formed with a second opening for elastically receiving a second end of the elongate light, and a first power branch that extends from the primary power cable and is of sufficient length to connect the main power cable to the elongate light.

2 Claims, 5 Drawing Sheets

FLEXIBLE AND ADAPTABLE LIGHT HARNESS AND WIRING

CROSS REFERENCE TO RELATED APPLICATION(S)

This application claims priority from U.S. Provisional Patent Application Ser. No. 61/935,690, filed Feb. 4, 2014, and which is incorporated by reference herein.

FIELD OF THE INVENTION

The present invention relates to a light support, and more particularly to a flexible and adaptable light harness and wiring.

DESCRIPTION OF THE RELATED ART

In conventional systems, an array of lights may be used to illuminate a rear surface of a photo or a display used as background for filming, or for display in other environments. The preferred lighting may use an LED light bar that can be installed in standard fluorescent light brackets. The LED lighting may be preferred over conventional fluorescent lighting for film use due to improved natural lighting wavelength output, reliability, cost, and/or adaptability.

Conventional methods of setting up the array of lights may involve using a plywood board, installing brackets to hold multiple LED light bars, and assembling the wiring needed at custom lengths to reach and power the multiple LED light bars on the plywood board.

The array of lights may need to be set up for a period of days, weeks, or months before being packed away and transported to another location, at which time the plywood mounting board, custom wiring, and equipment for the array of lights may be disassembled, discarded, or reused for other projects.

Substantial time may therefore be needed for conventional systems to assemble, set up, and break down mounting surfaces and wiring for LED light bars. Accordingly, improvements may be made over conventional systems.

SUMMARY OF THE INVENTION

In one embodiment, there is a light harness for holding a plurality of elongate lights. The harness includes a first flexible elongate member, a second flexible elongate member, a primary power cable attached to the first flexible elongate member, a first receiving section that is attached to the first flexible elongate member and is formed with a first opening for elastically receiving a first end of an elongate light, a second receiving section that is attached to the second flexible elongate member and is formed with a second opening for elastically receiving a second end of the elongate light, and a first power branch that extends from the primary power cable and is of sufficient length to connect the main power cable to the elongate light.

DESCRIPTION OF THE PREFERRED EMBODIMENTS

Figure 1:
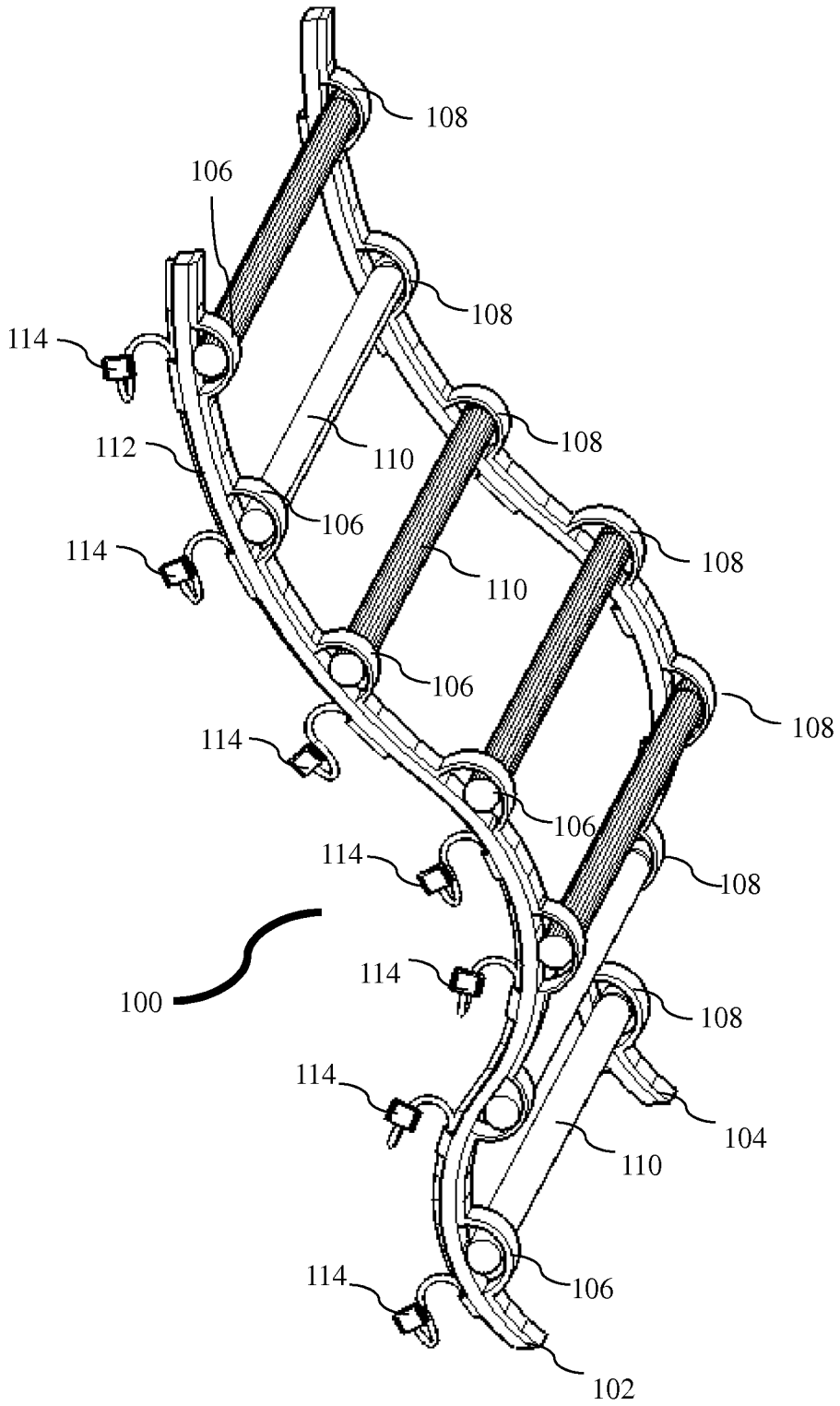
FIGS. 1, 2, and 3 are different perspective views of a flexible and adaptable light harness and wiring, according to an embodiment.

The flexible and adaptable light harness and wiring may be used to quickly set up and arrange multiple LED light bars.

For example, a user may lay the first flexible elongate member 102 (e.g., a rope, cable, or strap) on a flat surface next to a second flexible elongate member 104 (e.g., a second rope, cable, or strap). In other embodiments, the user may suspend the first flexible elongate member 102 and the second flexible elongate member 104 from a bar or other horizontally extending support. The user may then raise the horizontally extending support to a convenient height for inserting an LED light bar.

The user may insert one end of an LED light bar into a first receiving section 106, which may be an elastic loop or slot that is attached to the first flexible elongate member 102. The user may then insert a second end of the LED light bar into a second receiving section 108, which may be a second elastic loop or slot that is attached to the second flexible elongate member 104.

The user may then connect the LED light bar to a corresponding power branch 114 that extends from the primary power cable 112. The power branch 114 may include a pair of oppositely disposed push buttons (not shown) that are pushed to open a pair of receiving ports 124 to receive electrodes of the LED light bar.

The user may repeat the process to attach additional LED light bars to the first and second flexible elongate members.

To customize or adapt the light array, a user may select which first and second receiving sections to occupy with LED light bars and/or which LED light bars are coupled or decoupled from the primary power cable 112 via the corresponding power branch 114.

When the user wishes to raise the LED light array into place, the top ends of the first and second flexible elongate members may be attached to a rod that is lifted to a desired height. The straps and lights may then hang at predetermined locations to provide light from desired positions.

When the user wishes to store the light array or to detach the LED light bars from the light harness 100, the support for the first and second elongate members may be lowered at the same rate to allow the LED lights to be folded with the light harness into a box for storage.

By providing a light harness 100 with multiple, predesigned, light holding loops or slots, embodiments of the system may provide users with quick, economical systems for setting up and breaking down customizable LED light arrays without a need for extensive custom wiring or carpentry.

Figure 2:
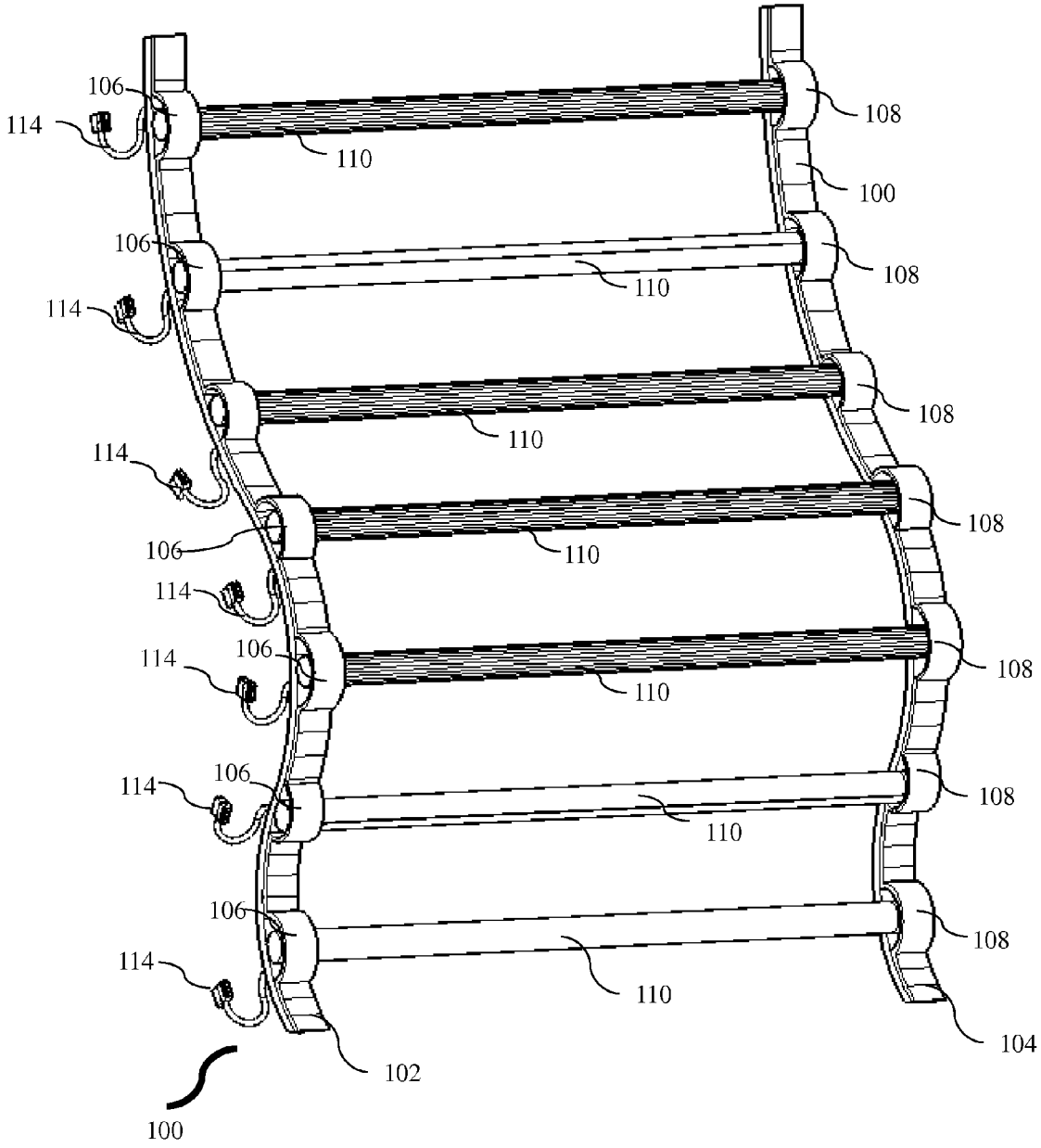
Figure 3:
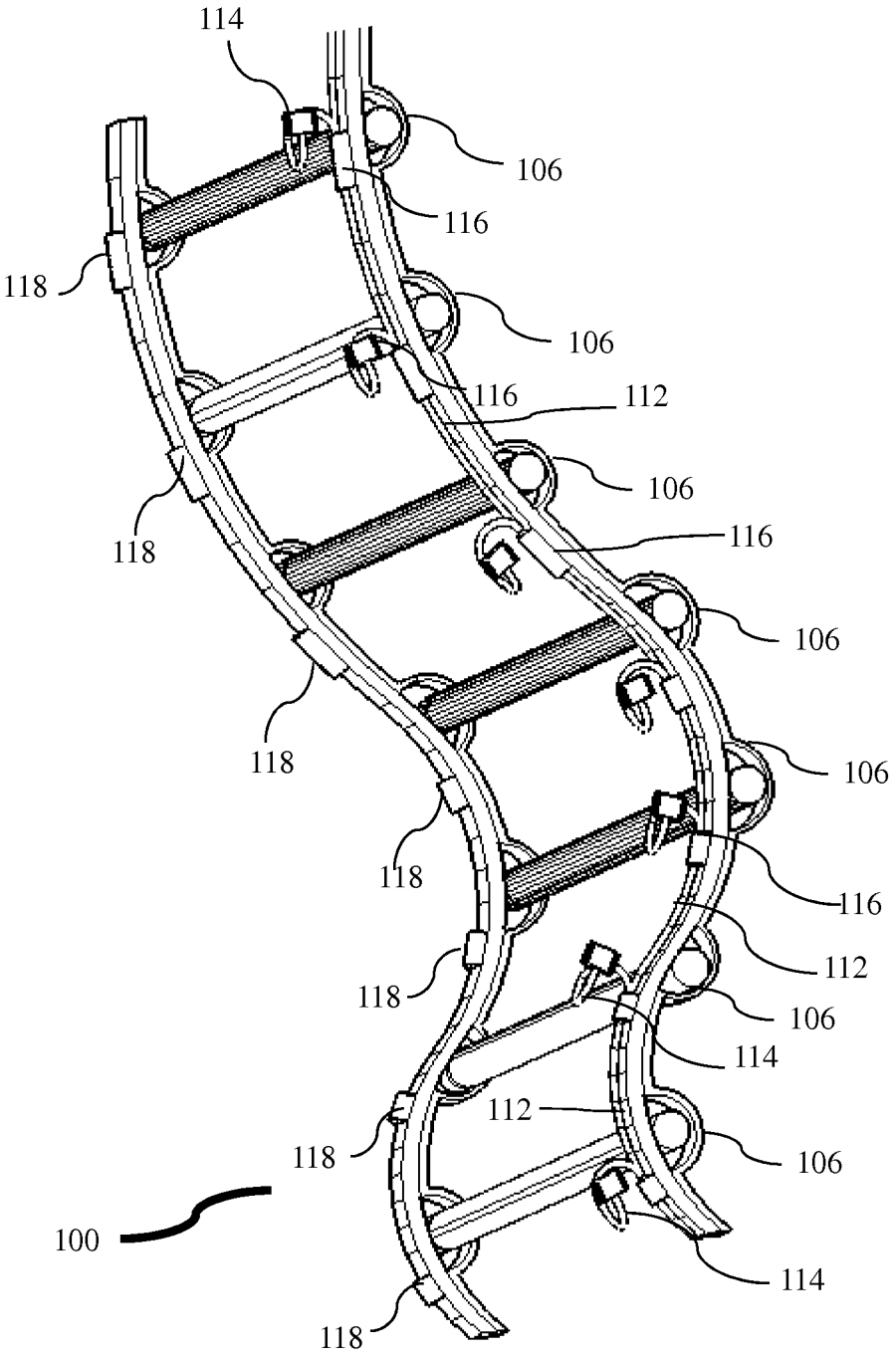

FIGS. 1, 2, and 3 are different perspective views of a flexible and adaptable light harness and wiring, according to an embodiment. FIGS. 1, 2, and 3 include the light harness 100, the first flexible elongate member 102 (e.g., a rope, cable, or strap), the second flexible elongate member 104 (e.g., a second rope, cable, or strap), multiple first receiving sections 106, multiple second receiving sections 108, the primary power cable 112, multiple power branches 114, multiple first cable holders 116, multiple secondary cable holders 118, secondary power cables 120, power coupling units 122, receiving ports 124, and securing sections 126. FIGS. 1, 2, and 3 also include multiple LED light bars 110, which may be provided separately from the light harness 100.

As shown first in FIG. 1, as well as in FIGS. 2 and 3, the first flexible elongate member 102 and the second flexible elongate member 104 work in conjunction to support opposite ends of multiple LED light bars 110. In variations of the embodiments illustrated, the first flexible elongate member 102 and the second flexible elongate member 104 may be longer or shorter, and may be configured to hold more or fewer LED light bars 110.

The first flexible elongate member 102 and the second flexible elongate member 104 are shown as curving, but in use may be extended and straight, folded, or curled into a coil. Each of the first flexible elongate member 102 and the second flexible elongate member 104 may be a composite structure formed from multiple elements, such as the multiple first receiving sections 106, multiple second receiving sections 108, primary power cable 112, multiple power branches 114, multiple first cable holders 116, and the multiple secondary cable holders 118.

As shown, the first elongate member 102 includes the first receiving sections 106, the first cable holders 116, the primary power cable 112, the power branches 114, and the first cable holders 116.

As shown, the second elongate member 104 includes the second receiving sections 108, and the second cable holders 118. In other embodiments, the second elongate member 104 may lack the second cable holders 118, or may include an additional primary cable (not shown) and additional power branches (not shown).

Figure 4:
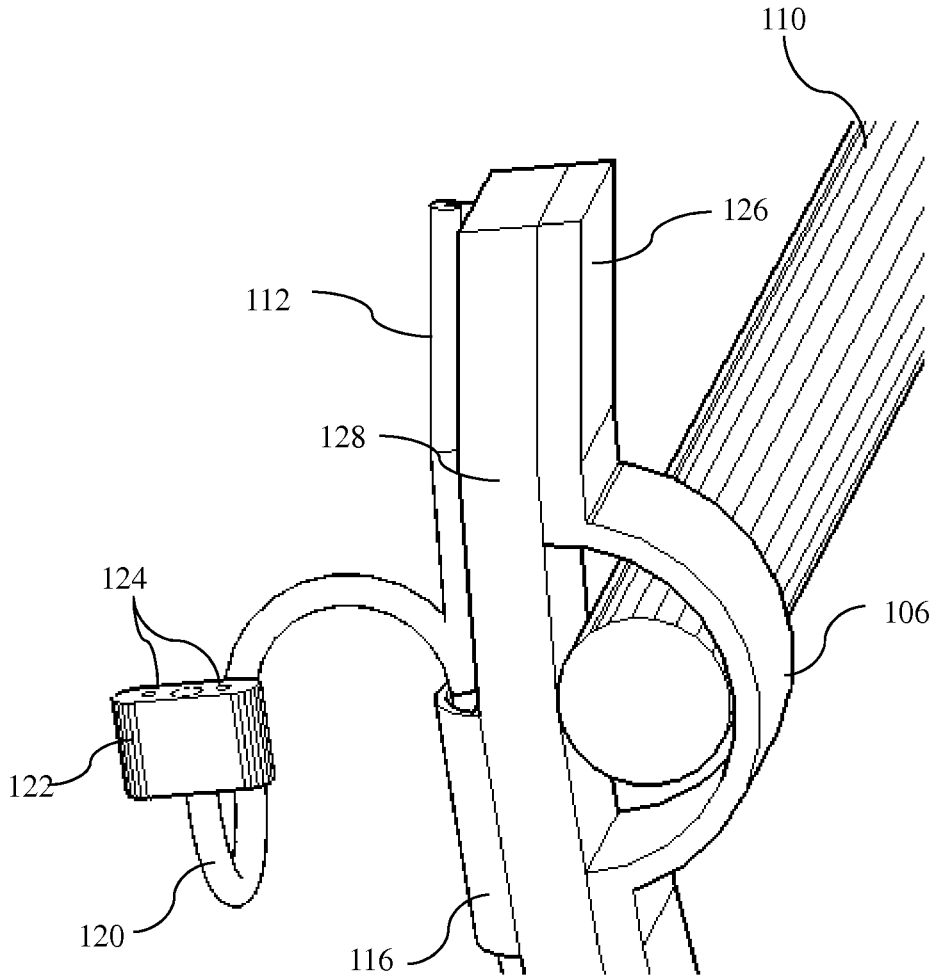
FIG. 4 is an enlarged perspective view of a portion of the flexible and adaptable light harness and wiring, according to an embodiment.

FIG. 4 is an enlarged perspective view of a portion of the flexible and adaptable light harness and wiring, according to an embodiment. As shown, each power branch 114 may include a secondary power cable 120 that extends laterally (e.g., along an axis that is perpendicular) relative to the main power cable 112 to provide power to an LED light bar held by the light harness 100. The secondary power cable 120 may be attached to a power coupling unit 122 that is formed with a pair of receiving ports 124. The power coupling unit 122 may include a pair of oppositely disposed push buttons (not shown) that are pushed to open a pair of receiving ports 124 to receive electrodes of the LED light bar. Each power branch 114 may be disposed close enough to permit coupling between the power branch 114, and the LED light bar 110.

As shown, the first and/or second elongate members may each be a composite structure that includes a strap 128, a securing section 126, a first or second receiving section, the main power cable 112, the first or second cable holder, and the corresponding power branch 114. The strap 128 may be made from a synthetic fiber capable of holding multiple LED light bars. The securing section 126 and the first receiving section 106 may be made from an elastic belt that is stitched/sewn to the strap 128. The elastic belt may include one segment that extends the length of the strap 128, or the elastic belt may be made up of multiple segments.

In some embodiments, the first or second cable holder may be disposed on the opposite side of the strap 128 from the first or second receiving sections. This may permit the primary power cable 112 to be held out of the way of the LED light bars 110 that are held by the light harness 100. In other embodiments, the first or second cable holder may be disposed on an adjacent side or the same side of the strap 128 as the first or second receiving stations.

The first or second cable holder may be formed from an elastic or additional strap that is sewn to the strap 128. In other embodiments, the first or second cable holder may be composed of a velcro strap, buckle, or other attaching system that permits insertion or removal of the primary power cable 112. The first or second cable holder may hold the primary power cable 112 to the strap 128 and/or may support the primary power cable 112 to prevent it from slipping off the light harness 100.

The light harness 100 may include multiple light locations for attaching and powering an LED light bar, each including a pair of first and second receiving sections and at least one power branch 114. The light locations may be disposed at regular intervals along the light harness 100, e.g., every 4, 6, 12, 18, or 24 inches. In preferred embodiments, the light locations may be separated by between 6 and 18 inches. In other embodiments, the light locations may be as close together as possible.

Figure 5A:
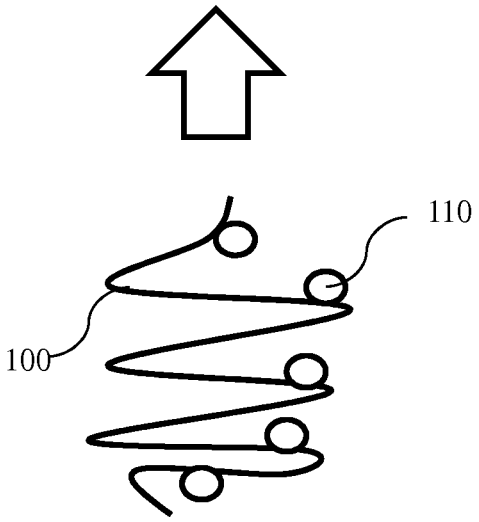
FIGS. 5A and 5B are illustrations of a method of using the flexible and adaptable light harness and wiring, according to an embodiment.
Figure 5B:
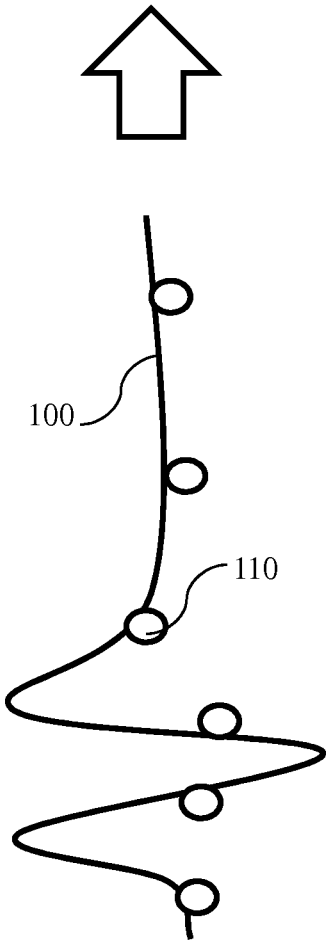

FIGS. 5A and 5B are side view illustrations of a method of using the flexible and adaptable light harness and wiring, according to an embodiment. In FIG. 5A, the light harness 100 can be seen to have been folded multiple times with attached LED light bars 110. Only an end of each LED light bar 110 and one of the first or second flexible elongate members is shown in FIG. 5A.

When drawn upwards, as shown in FIG. 5B, the light harness 100 may be shown to support multiple LED light bars 110 above and below each other. The light harness 100 may continue to be drawn upwards until it has been fully extended, thus allowing each of the inserted LED light bars to hang at its predetermined position.

Although the invention has been described using specific terms, devices, and/or methods, such description is for illustrative purposes of the preferred embodiment(s) only. Changes may be made to the preferred embodiment(s) by those of ordinary skill in the art without departing from the scope of the present invention, which is set forth in the following claims. In addition, it should be understood that aspects of the preferred embodiment(s) generally may be interchanged in whole or in part.

What is claimed is:

1. A light harness for holding a plurality of elongate lights, comprising:

a first flexible elongate member;

a second flexible elongate member;

a primary power cable attached to the first flexible elongate member;

a first receiving section that is attached to the first flexible elongate member and is formed with a first opening for elastically receiving a first end of an elongate light;

a second receiving section that is attached to the second flexible elongate member and is formed with a second opening for elastically receiving a second end of the elongate light; and a first power branch that extends from the primary power cable and is of sufficient length to connect the main power cable to the elongate light.

2. The light harness of claim 1, wherein the first opening and the second opening open along an axis that is perpendicular to a longitudinal axis of the corresponding first or second flexible elongate member, and/or along an axis parallel to a longitudinal axis of an attached elongate light.

* * * * *

UNITED STATES PATENT AND TRADEMARK OFFICE

CERTIFICATE OF CORRECTION

PATENT NO. : 9,239,134 B1
APPLICATION NO. : 14/613258
DATED : January 19, 2016
INVENTOR(S) : Guillermo Macias It is certified that error appears in the above-identified patent and that said Letters Patent is hereby corrected as shown below:

IN THE CLAIMS

Column 4, line 56 (in claim 1), change "main" to --primary--

Signed and Sealed this
Third Day of May, 2016

Michelle K. Lee

Michelle K. Lee
*Director of the United States Patent and Trademark Office*